US008513581B2

(12) United States Patent
Geswender et al.

(10) Patent No.: US 8,513,581 B2
(45) Date of Patent: Aug. 20, 2013

(54) MULTI-CALIBER FUZE KIT AND METHODS FOR SAME

(75) Inventors: Chris E. Geswender, Green Valley, AZ (US); Cesar Sanchez, Tucson, AZ (US); Matthew A. Zamora, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 1127 days.

(21) Appl. No.: 12/469,443

(22) Filed: May 20, 2009

(65) Prior Publication Data

US 2012/0211592 A1 Aug. 23, 2012

Related U.S. Application Data

(60) Provisional application No. 61/054,639, filed on May 20, 2008.

(51) Int. Cl.
*F42B 15/01* (2006.01)

(52) U.S. Cl.
USPC ..... 244/3.24; 102/385

(58) Field of Classification Search
USPC ..... 244/3.24, 3.26, 3.27, 3.28, 3.29, 244/3.3; 102/384, 385
See application file for complete search history.

(56) References Cited

U.S. PATENT DOCUMENTS 3,546,997 A * 12/1970 Biehl et al. ..... 86/1.1
3,633,846 A * 1/1972 Biggs, Jr. ..... 244/3.27
4,205,810 A 6/1980 Ishimitsu
4,512,537 A * 4/1985 Sebestyen et al. ..... 244/3.21
4,905,602 A * 3/1990 Buckland ..... 102/520
5,007,875 A 4/1991 Dasa
5,048,773 A * 9/1991 Washington et al. ..... 244/3.28

(Continued)

FOREIGN PATENT DOCUMENTS

WO WO-2010011245 A2 1/2010
WO WO-2010011245 A9 1/2010
WO WO-2010011245 A3 3/2010

OTHER PUBLICATIONS

International Application Serial No. PCT/US2009/003109, Search Report mailed Jan. 27, 2010, 3 pgs.

(Continued)

*Primary Examiner* — Benjamin P Lee
(74) *Attorney, Agent, or Firm* — Schwegman Lundberg & Woessner, P.A.

(57) ABSTRACT

A multi-caliber fuze kit includes a fuze housing configured for coupling with multiple projectiles. One or more canards are moveably coupled with the fuze housing. The one or more canards are adjustable between two or more canard configurations. In a first canard configuration, the one or more canards are at a first canard angle relative to a bore sight of the fuze housing, and the first canard angle is configured for use with a first projectile. In a second canard configuration, the one or more canards are at a second canard angle relative to the bore sight of the fuze housing, and the second canard angle is configured for use with a second projectile. The first and second canard angles are different. In another example, in the first canard configuration the one or more canards include a first canard shape configured to provide a first specified trajectory with the first projectile. In the second canard configuration the one or more canards include a second canard shape configured to provide a second specified trajectory with the second projectile. The first canard shape and the second canard shape are different.

18 Claims, 6 Drawing Sheets

(56) References Cited

U.S. PATENT DOCUMENTS

| | | | | |
|---|---|---|---|---|
| 5,062,585 | A * | 11/1991 | Mikhail | 244/3.24 |
| 6,227,096 | B1 * | 5/2001 | Thomas | 89/1.54 |
| 6,237,496 | B1 * | 5/2001 | Abbott | 102/384 |
| 6,502,786 | B2 * | 1/2003 | Rupert et al. | 244/3.27 |
| 6,604,705 | B2 * | 8/2003 | Pellegri et al. | 244/3.24 |
| 6,666,402 | B2 | 12/2003 | Rupert et al. | |
| 6,969,216 | B2 | 11/2005 | Driver | |
| 6,981,672 | B2 * | 1/2006 | Clancy et al. | 244/3.24 |
| 7,163,176 | B1 | 1/2007 | Geswender et al. | |
| 7,165,742 | B2 * | 1/2007 | Kusic | 244/34 R |
| 7,198,532 | B2 | 4/2007 | Field | |
| 7,267,298 | B2 * | 9/2007 | Leininger | 244/3.24 |
| 7,354,017 | B2 * | 4/2008 | Morris et al. | 244/3.23 |
| 7,584,922 | B2 * | 9/2009 | Bar et al. | 244/3.24 |
| 7,905,182 | B2 * | 3/2011 | Janik et al. | 102/517 |
| 8,026,465 | B1 * | 9/2011 | Fraysse, Jr. | 244/3.22 |
| 8,124,921 | B2 * | 2/2012 | Geswender et al. | 244/3.1 |
| 8,203,108 | B2 * | 6/2012 | Geswender et al. | 244/3.24 |
| 2002/0117580 | A1 * | 8/2002 | Rupert et al. | 244/3.24 |
| 2002/0139896 | A1 * | 10/2002 | Pellegri et al. | 244/3.24 |
| 2005/0056723 | A1 * | 3/2005 | Clancy et al. | 244/3.24 |
| 2006/0071120 | A1 * | 4/2006 | Selin et al. | 244/3.27 |
| 2008/0029641 | A1 * | 2/2008 | Carlson et al. | 244/3.24 |
| 2009/0206192 | A1 * | 8/2009 | Sanderson et al. | 244/3.27 |
| 2010/0032515 | A1 * | 2/2010 | Geswender et al. | 244/3.25 |
| 2012/0181376 | A1 * | 7/2012 | Flood et al. | 244/3.27 |
| 2012/0211592 | A1 * | 8/2012 | Geswender et al. | 244/3.21 |
| 2012/0241551 | A1 * | 9/2012 | Rastegar et al. | 244/3.24 |

OTHER PUBLICATIONS

International Application Serial No. PCT/US2009/003109, Written Opinion mailed Jan. 27, 2010, 9 pgs.

* cited by examiner

MULTI-CALIBER FUZE KIT AND METHODS FOR SAME

CROSS-REFERENCES TO RELATED APPLICATIONS

This application claims the benefit of U.S. Provisional Patent Application No. 61/054,639, filed May 20, 2008 which is incorporated herein by reference in its entirety.

TECHNICAL FIELD

Guide surfaces for projectiles.

BACKGROUND

Modern warfare is based on mission speed, high lethality per round, and minimizing collateral damage. These criteria require projectiles capable of delivery munitions with high precision. Unguided artillery shells follow a ballistic trajectory, which is generally predictable but practically results in larger variability in the trajectory at ranges greater than 20 miles due to variations in atmospheric conditions; wind speed and direction, temperature, precipitation and the like. Variations in the weapons system; manufacturing tolerances, barrel condition, propellant charge temperature and gun laying errors may also contribute to variability in the shell trajectory. As the ballistic range increases, the potential impact of the projectile variation grows until the projectile delivered lethality is too low to effectively execute the fire mission.

Precision in such weapons comes at a high cost. Fully guided rounds are expensive and use GPS/IMU technology to precisely guide the missile to a target. Such high cost systems are not easily modified across the millions of artillery rounds in existing inventories or easily integrated into the design of new artillery rounds. Further, control surfaces including fins (e.g., canards), are sized, shaped and angled based upon the dimensions, mass moment of inertia and weight of the projectile. The control surfaces used with a projectile of one caliber (e.g., 155 mm) are less useful and actually degrade trajectory control of a projectile having a different caliber (e.g., 105 mm).

SUMMARY

In accordance with some embodiments, a system and method for providing optimum precise delivery of a projectile by way of adjustable canards is provided. Other features and advantages will become apparent from the following description of the preferred example, which description should be taken in conjunction with the accompanying drawings.

BRIEF DESCRIPTION OF THE DRAWINGS

A more complete understanding of the present subject matter may be derived by referring to the detailed description and claims when considered in connection with the following illustrative Figures. In the following Figures, like reference numbers refer to similar elements and steps throughout the Figures.

Elements and steps in the Figures are illustrated for simplicity and clarity and have not necessarily been rendered according to any particular sequence. For example, steps that may be performed concurrently or in different order are illustrated in the Figures to help to improve understanding of examples of the present subject matter.

DESCRIPTION OF THE DRAWINGS

In the following detailed description, reference is made to the accompanying drawings which form a part hereof, and in which is shown by way of illustration specific examples in which the subject matter may be practiced. These examples are described in sufficient detail to enable those skilled in the art to practice the subject matter, and it is to be understood that other examples may be utilized and that structural changes may be made without departing from the scope of the present subject matter. Therefore, the following detailed description is not to be taken in a limiting sense, and the scope of the present subject matter is defined by the appended claims and their equivalents.

The present subject matter may be described in terms of functional block components and various processing steps. Such functional blocks may be realized by any number of techniques, technologies, and methods configured to perform the specified functions and achieve the various results. For example, the present subject matter may employ various materials, actuators, electronics, shape, airflow surfaces, reinforcing structures, explosives and the like, which may carry out a variety of functions. In addition, the present subject matter may be practiced in conjunction with any number of devices, and the systems described are merely exemplary applications.

The inventive subject matter provides a cross range and down range (2-D) correction method and system for applying appropriate canard effectiveness to projectiles of multiple sizes using a single fuze kit. Aerodynamic surfaces, also called canards, are adjusted to a predetermined angle configuration, with respect to the projectile bore sight, to provide precision guidance using a single fuze kit regardless of the projectile size. The canards on the fuze kit extend to maintain a ratio of tipping moment to mass inertia moment of the projectile. However, canards on a fuze kit used for maintaining an aerodynamic relationship for a 155 mm projectile may overpower, with tipping force, a smaller projectile such as a 105 mm projectile. The inventive subject matter is a fuze kit that is produced to a most aggressive need, i.e., a 155 mm projectile, and having the capability to re-size and/or re-shape the canards to adjust the fuze kit for applicability to a smaller caliber projectile. The effect of modifying the canards is for the purpose of reducing the tipping moment aerodynamically.

Figure 1:
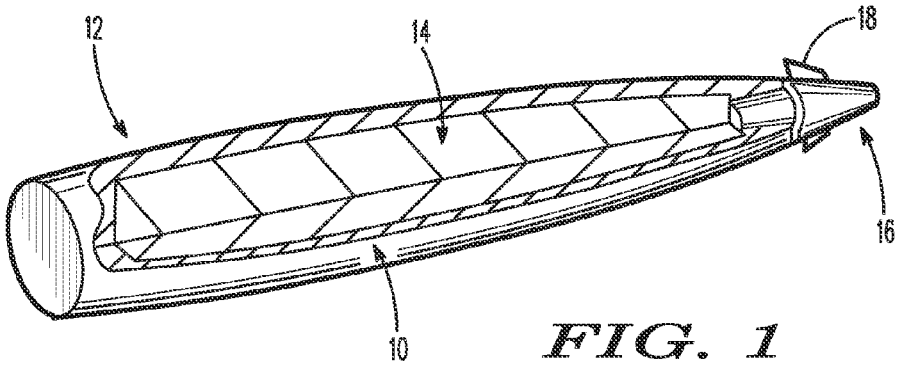
FIG. 1 is a perspective cutaway view of an unguided stabilized projectile with one example of a multi-caliber fuze kit coupled with the projectile in accordance with some embodiments.

FIG. 1 is an unguided spin stabilized projectile 10 having a housing 12 and an explosive payload 14. A multi-caliber fuze kit 16 is attached to the housing 12, as by threading. A standard fuze kit includes a fuse, a safe and arm mechanism, battery, an initialization coil and a flight computer. High spin rate projectiles are stabilized gyroscopically, i.e. by the spinning of the projectile itself. Low spin rate projectiles are stabilized by the addition of aerodynamic surfaces, i.e., fins, to the airframe. As modified to provide 2-D correction, the fuze kit 16 includes at least one canard 18 in a deployed position. In general, the fuze kit 16 can be used with a standard housing 12 and payload 14. However, as discussed above, canards 18 used for providing canard effectiveness may be excessive for smaller caliber projectiles. The modified multi-caliber fuze kit 16 can be implemented to accommodate millions of projectiles in inventory by easily retrofitting and adjusting the canards 18 as necessary.

Figure 2:
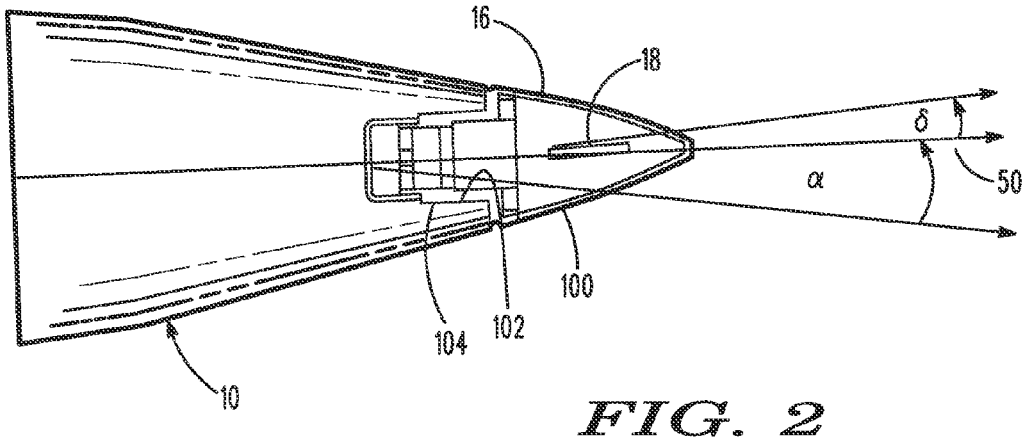
FIG. 2 is a cross-sectional view of the multi-caliber fuze kit shown in FIG. 1 coupled with the projectile in accordance with some embodiments.

Referring now to FIG. 2, one example of multi-caliber the fuze kit 16 is shown coupled with the projectile 10. The fuze kit 16 includes a fuze housing 100 having a fuze coupling feature 102. The fuze coupling feature 102 is coupled along a projectile coupling feature 104 of the projectile 10. As previously described, the fuze kit 16 is coupled with the projectile 10 by way of one or more coupling features including, but not limited to, threading, mechanical interfitting features, screws, bolts and the like. Such coupling features are included on the fuze coupling feature 102 for engagement with the corresponding projectile feature coupling 104 of the projectile 10.

FIG. 2 shows the modified fuze kit 16 including at least one adjustable canard 18. The adjustable canard 18 may be tilted as necessary, prior to deployment of the projectile, as a function of the projectile size. To generate lift, the bore sight 50 of the projectile 10 forms an angle of attack, $\alpha$, with respect to the wind. Tilting the adjustable canard 18 at an angle, $\partial$, creates an effective angle of attack $\alpha_\partial=\alpha+\partial$, that generates lift. The canard angle, $\partial$, is movable to provide a degree of control that is dependent upon the caliber of the projectile. That is to say, the angle $\partial$ of the one or more canards to provide desired trajectories varies between projectiles with differing dimensions and mass moments of inertia. The same fuze kit is thereby used across a plurality of differing projectiles with corresponding different angles $\partial$ of the canards 18 to provide desired trajectories for each of the projectiles despite varied projectile dimensions and mass moments of inertia. As further discussed below configuring of the canards 18 of the modified fuze kit 16 to service one of a variety of projectiles is easily performed in the field.

Figure 3:
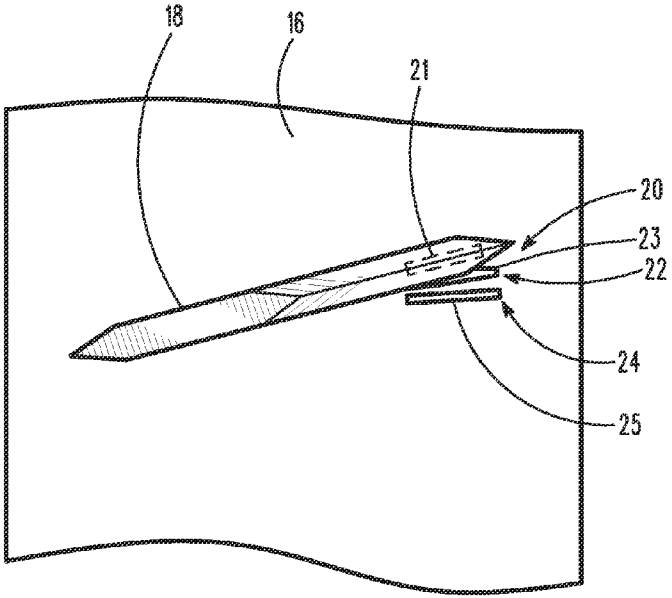
FIG. 3 is a side view of one example of an adjustable canard on the multi-caliber fuze kit shown in FIG. 1 in accordance with some embodiments.

FIG. 3 is a view of the adjustable canard 18 in one of several possible positions defining the angle, $\partial$. A position 20, 22, 24 for the canard 18 is specified based on the caliber of the projectile. Therefore, a first position 20 is dedicated to a first caliber projectile, a second position 22 is dedicated to a second caliber and at least a third position 24 is dedicated to a third caliber projectile. Prior to launching the projectile and/or upon attachment of the fuze kit 16 to the projectile, a predetermined canard position 20, 22, 24 is set on the fuze kit 16, as determined by the caliber of the projectile. The position of the canard 18 maintains the ratio of tipping moment to mass inertia moment for the projectile. For example, a first position 20 may have an angle, $\partial$ of 10° and may be applicable for a 155 mm caliber projectile. The second position 22 may have an angle, $\partial$ of 7° as would be applicable for a 127 mm caliber projectile. Similarly, the at least third position 24 may have an angle, $\partial$ of 5° and may be applicable for a 105 mm caliber projectile.

The greater the angle, $\partial$ the greater the lift provided by the canard 18. The angle, $\partial$ corresponding to position 20 for the 155 mm projectile (e.g., 10°) thereby provides enhanced lift for the larger and heavier projectile relative to the smaller 127 and 105 mm projectiles without causing tumbling of the projectile. Conversely, because the 127 and 105 mm projectiles are smaller and have lower mass moments of inertia, respectively, less lift is needed to provide the desired trajectory. Using the greater angle, $\partial$ for the 155 mm projectile would cause tipping and tumbling of the smaller projectiles. The angle, $\partial$ for the 105 mm projectile is thereby less than that of the 155 and 127 mm projectile and the angle, $\partial$ for the 127 mm projectile is thereby less than that of the 155 mm projectile. By providing separate positions 20, 22, 24 and corresponding angles for each of the different projectiles a desired trajectory is provided for each of the projectiles by a single fuze kit 16. Similarly, because each projectile has a corresponding angle on the fuze kit 16 tipping and tumbling of the projectile (e.g., by using a fuze kit with fixed canards at an angle inappropriate for a desired projectile) are thereby avoided.

Figure 4:
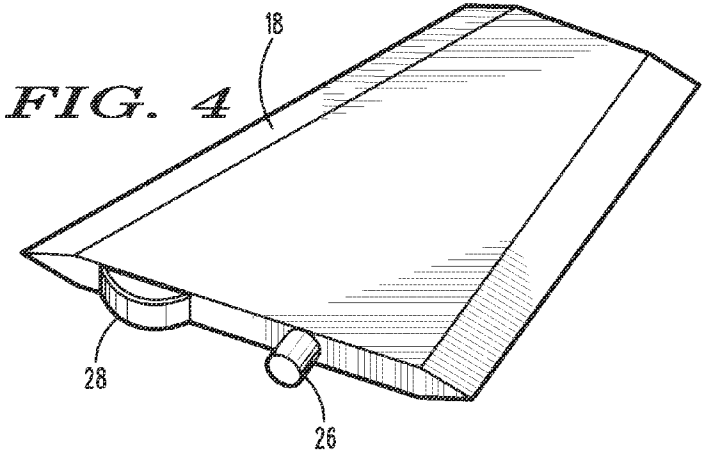
FIG. 4 is a perspective view of the canard shown in FIG. 3 including a spring loaded locking mechanism in accordance with some embodiments.

In one example, shown in FIG. 4, the canard 18 of the multi-caliber fuze kit 16 is shown in a perspective view, wherein the canard rotates about a canard pin 26 coupled between the canard 18 and the fuze housing 100. The canard pin 26 provides a fixed axis for rotation of the canard 18 relative to the fuze housing 100. A locking mechanism 28 holds the canard 18 in the desired position. In the example shown in FIG. 4, a spring loaded lock mechanism 28 is used as part of a detent or push-lock system (further described below). It should be noted that there are numerous modifications that may be made, by one of ordinary skill in the art, when applying the locking mechanism to the canard design, without departing from the scope of the inventive subject matter.

In one example, the locking mechanism 28 is disposed within one of grooves 21, 23, 25 located at positions 20, 22, 24, respectively, as shown in FIG. 3. In operation, the canard 18 is rotated to one of the desired positions 20, 22, 24 for use with a specified projectile. The desired position 20, 22, 24 corresponds to the angle, $\partial$ needed to provide the desired trajectory to the specified projectile. The locking mechanism 28 is received in the corresponding groove 21, 23, 25 at the desired position 20, 22, 24 thereby fixing the canard 18 in place. As described below, the locking mechanism is operated, in one example, by applying sufficient torque to the canard 18 to rotate the canard relative to the fuze housing 100.

The locking mechanism 28 (e.g., a biased detent) is disengaged from the groove thereby allowing the canard 18 to rotate. In another example (also described below), the locking mechanism includes a push-lock system including a detent and tool feature. A tool, such as a screwdriver, is engaged against the tool feature to lift the locking mechanism 28 relative to the grooves and allow rotation of the canard 18. The locking mechanism 28 is received within a desired groove of one of the grooves 21, 23, 25 after rotation of the canard 18 to the desired position. A biasing element in the locking mechanism 28 (spring, elastomer, and the like) biases the locking mechanism into the desired groove 21, 23, 25 to fix the canard 18 in position.

Figure 5:
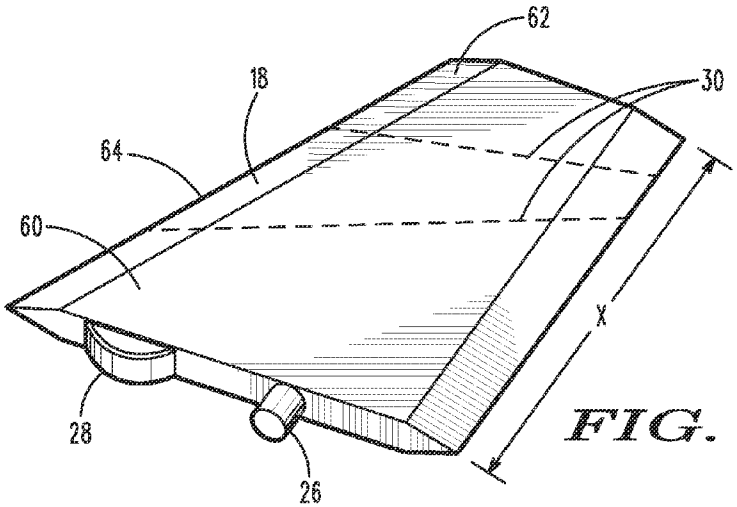
FIG. 5 is a perspective view of one example of a canard having an adjustable shape in accordance with some embodiments.

As shown in FIG. 5, one example of the shape of the canard 18 is shown. The canard 18 of the multi-caliber fuze kit 16 is capable of modification to alter the canard shape and dimensions. For example, the canard 18 has a dimension, x, that is dimensioned according to the projectile caliber. In one option, a scored portion 30 is formed in the canard 18 to allow removal of one or more portions of the canard 18 to configure the canard between two or more projectile calibers. Removal of portions of one or more of the canards 18 at the scored portions 30 changes various dimensions of the canard 18. In other examples, the height, the shape, the profile, and the like may all be adjustable in accordance with the inventive subject matter herein. The adjustment to the dimensions, while shown as a scored portion, may also be accomplished in a manner other than scoring, such as connecting tabs, twist-off sections, or other variations too numerous to mention herein.

Referring to FIG. 5, the canard shown includes a base canard section 60, a first canard tab 62 and a second canard tab 64. In one example, removal of one or both of the first and second canard tabs 62, 64 modifies the dimension, x, in order to adjust the path of the projectile. In another example, removal of one or both of the first and second canard tabs 62, 64 modifies the shape (in addition to the dimension x) of the canard 18 allowing the fuze kit 16 (FIG. 1) to be used with a variety of projectile calibers. Although first and second canard tabs 62, 64 are shown in FIG. 5, in other examples one or more canards 18 include one, two or more tabs for use with a corresponding number of projectiles. The canard 18 in various configurations is thereby able to direct a variety of different projectiles along trajectories according to the adjustable canard shapes and dimensions.

For instance, in a first configuration, the canard 18 with the first and second canard tabs 62, 64 coupled with the base canard section 60 is used with the fuze kit 16 coupled with a first larger projectile (e.g., a 155 mm projectile). In a second configuration, the first canard tab 62 is removed from the canard 18, and the canard 18 with the base canard section 60 and the second canard tab 64 is usable with a fuze kit 16 coupled with a second smaller projectile (e.g., a 127 mm projectile). In a third example configuration, the first and second canard tabs 62, 64 are removed from the canard 18, and the canard including the base canard section 60 is used with a fuze kit 16 coupled with a projectile smaller than the projectiles used with the fuze kit in the first and second configurations (e.g., a 105 mm projectile). In other words, for a smaller caliber projectile, the canard dimension x and shape are adjustable. Therefore, prior to deployment of the projectile, the dimension, x, and the shape of the canard 18 are set on the fuze kit 16 in order to optimize the stabilization of the projectile. In one example, the adjustable size and shape of the canard 18 are accomplished by "snapping off" the scored portion (first or second tabs 62, 64) of the canard thereby bringing the dimension, x, to the desired size and adjusting the shape of the canard. The scored portion may change various dimensions of the canard 18. For example, the height, the shape, the profile, etc. may all be adjustable in accordance with the inventive subject matter herein. The adjustment to the dimensions, while shown as a scored portion, may also be accomplished in a manner other than scoring, such as connecting tabs, twist-off sections, or other variations too numerous to mention herein.

The fuze kit 16 with the one or more configurable canards 18 is able to guide the various projectiles along defined trajectories according to the shape and dimensions of the canard in each configuration. Further, the fuze kit 16 in any of the configurations is able to substantially prevent tumbling of the various projectiles where the canard configuration is adjusted to match the appropriate projectile.

Figure 7:
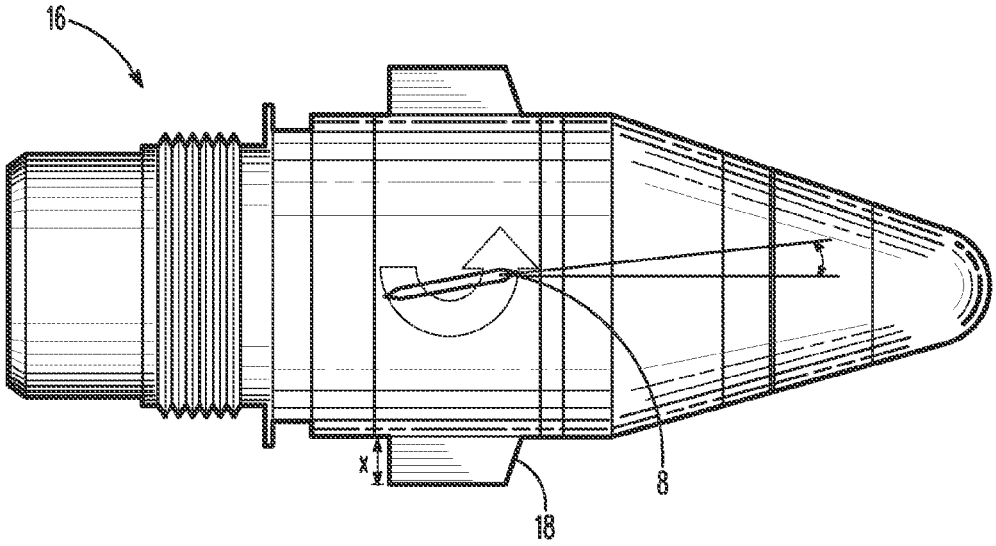
FIG. 7 is a perspective view of a second configuration for a multi-caliber fuze kit with one or more adjustable canards in accordance with some embodiments.
Figure 6:
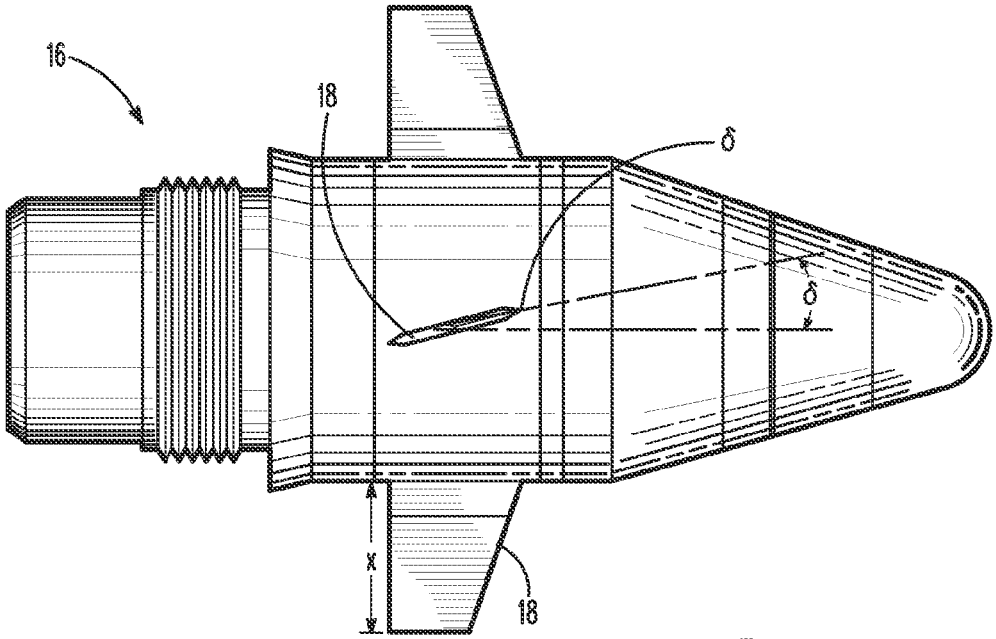
FIG. 6 is a perspective view of a first configuration for a multi-caliber fuze kit with one or more adjustable canards in accordance with some embodiments.

The canard 18 on the fuze kit 16 is set to a position prior to launch of the projectile 10 (FIG. 1). In another example, the canard 18 is configured to a shape prior to launch of the projectile 10. FIG. 6 is one example of a configuration for the modified fuze kit 16. The canards 18 are set to a desired angle, ∂ and have a set x dimension. In comparison, FIG. 7 shows another example of a configuration for the modified fuze kit 16. The canard 18 is set to a desired angle, ∂ less than the angle shown in FIG. 6, and the dimension, x, is modified as well. The canard position, shape and size are dependent upon the caliber of the projectile. As shown in FIG. 6, the canard 18 is used with a relatively larger projectile than the projectile used with the canard configuration shown in FIG. 7. For instance, the canard 18 in FIG. 6 has a larger shape (and corresponding larger guide surface), and a greater angle, ∂ relative to the angle shown in FIG. 7. The larger shape and angle, ∂ allow the fuze kit 16 to guide a larger projectile along a desired trajectory. In contrast, the canard configuration in FIG. 7 includes a smaller canard shape with a smaller guide surface, and a smaller angle, ∂. The smaller shape and angle, ∂ facilitate guiding of a relatively smaller projectile along a desired trajectory. The smaller shape and angle, ∂ also substantially prevent tumbling of the smaller projectile that would accompany the use of a fuze kit with non-adjustable canards sized and shaped for use with a larger projectile. The single fuze kit 16 with the configurable canards 18 thereby allows adjustment of the aerodynamic tipping moment for a plurality of projectile sizes, and corresponding prevention of tipping, by way of adjusting the angle, ∂ and the canard shape of the canards 18. In other examples, only one of the canard shape and angle are changed when the fuze kit 16 is configured for another projectile. That is to say, when the fuze kit 16 is configured from an initial configuration to a configuration for a different projectile, one of the canard shape and the canard angle are adjusted.

Figure 8A:
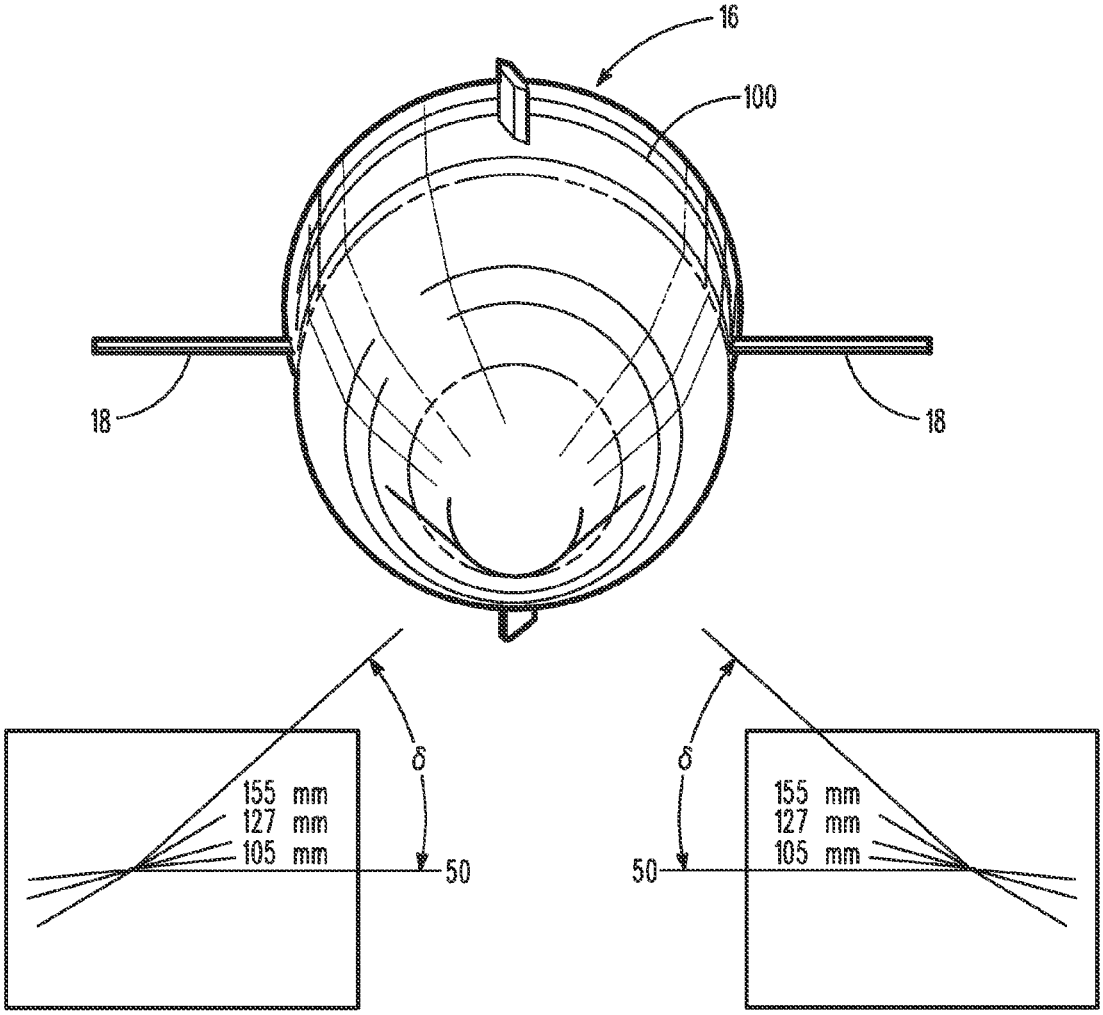
FIG. 8A is a front perspective view of another example of a projectile including one or more rotatable adjustable canards with a detent locking mechanism in accordance with some embodiments.
Figure 8B:
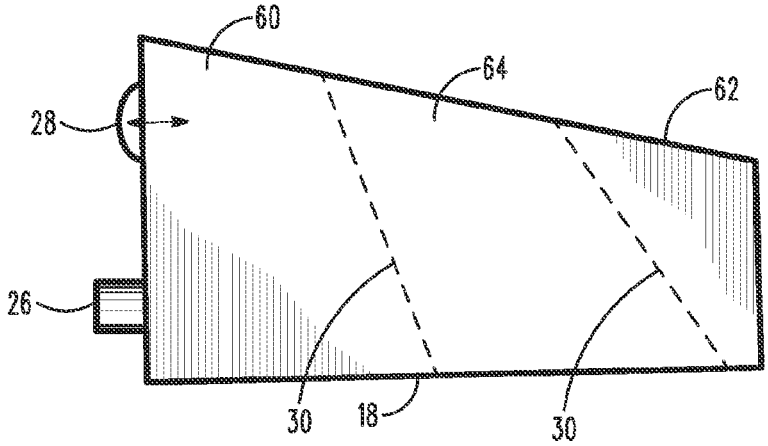
FIG. 8B is a top view of the one or more rotatable adjustable canards shown in FIG. 8A with an adjustable shape in accordance with some embodiments.

Referring now to FIGS. 8A and 8B, one example of a fuze kit 16 is shown having one or more adjustable canards 18. As previously described the one or more canards 18 are rotatable around a canard pin 26 that couples the one or more canards 18 with the fuze kit 16. The canard 18 in one example, includes a locking mechanism 28 (e.g., a detent) that is positionable within grooves 21, 23, 25 shown in FIG. 3. The canards 18 are positionable within the grooves 21, 23 and 25 to correspondingly position the one or more canards 18 according to desired positions 20, 22, 24 (also shown in FIG. 3). The positions 20, 22, 24 and the grooves 21, 23, 25 correspond with specified projectiles sizes, such as a 155 mm projectile for position 20, a 127 mm projectile for position 22, and a 105 mm projectile for position 24. By rotating the one or more canards 18 into the specified grooves corresponding to the positions for each of the specified projectiles the canards 18 are thereby configured to guide the projectile along a desired trajectory. Once rotated into the desired position the locking mechanism 28, as shown in FIG. 8B as a detent, retains the one or more canards 18 in the desired position to ensure the canard 18 guides the projectile along the desired trajectory.

In operation, the one or more canards 18 are rotated relative to the fuze kit 16 across an angle delta as shown in FIG. 8A. In one example, the canard 18 shown in FIG. 8B is rotated relative to the fuze kit 16. Rotation of the canard 18 forces the detent locking mechanism 28 to retract into the canard 18 overcoming a natural bias due to a biasing mechanism, such as a spring located within the canard. Once the bias is overcome the canard 18 is free to rotate relative to the fuze kit 16 until the canard rotates over one of the grooves 21, 23 and 25 shown in FIG. 3. As the canard rotates over one of these grooves, the locking mechanism 28 is free to project from the canard 18 and fall into one of the grooves 21, 23 and 25. Positioning of the locking mechanism 28 within the grooves locks the canard 18 in place on the fuze kit 16. If further movement of the canard 18 is required into another groove beyond the groove the canard is presently positioned in the canard is further rotated allowing the locking mechanism 28 to deflect again into the canard 18 freeing the canard to rotate relative to the fuze kit 16. Once the canard 18 is positioned in the third groove the locking mechanism 28 projects out of the canard and into the groove locking the canard 18 in the desired position on the fuze kit 16. As shown in FIG. 8A, the larger angles ∂, for example, for the 155 mm projectile, positions the canard at a greater angle relative to the bore sight 50 shown in (originally shown in FIG. 2). The greater angle ∂ of the canard 18 assists the canard in guiding the larger projectile along the desired trajectory. In contrast, when the fuze kit 16 is used with a smaller projectile a correspondingly smaller angle ∂ of the canard 18 is necessary to guide the projectile along the desired trajectory. That is to say, the canard 18 is positioned at an angle ∂ relative to the bore sight 50 that is smaller than the angle used with the 155 mm projectile. The smaller angle ∂ for the smaller projectile (e.g., 127 mm or 105 mm projectiles) allows the canard 18 to adequately guide the projectile along the desired trajectory without providing an excessive canard angle ∂ that would otherwise be used with a larger projectile. Using the larger angle ∂ with the smaller projectile would cause tipping and tumbling of the projectile after it is launched. The adjustable configuration of the one or more canards 18 avoids tumbling and tipping by matching the appropriate canard angle with the corresponding projectile.

FIG. 8B shows another example of the canard 18 including removable tabs that allow for adjustment of the canard shape and dimensions to guide the projectile along a desired trajectory. In one example, the canard 18 with the adjustable shape and dimension shown in FIG. 8B is combined with a canard 18 shown in FIG. 8A that is rotatable around the fuze kit 16. In still another example, the canard 18 shown in FIG. 8B with the removable tabs is used alone to adjust the shape of the canards on the fuze kit 16 and thereby guide the projectile along the desired trajectory. That is to say, the adjustable angle and the adjustable shape and dimensions of the canard are useable alone or together to achieve guidance of a plurality of projectiles having different dimensions and mass moments of inertia along desired trajectories.

Referring now to FIG. 8B, the canard 18 is shown with a base canard section 60, a first canard tab 62 and a second canard tab 64. As previously described, to guide a projectile having larger dimensions, mass and corresponding mass moment of inertia a canard is needed having a larger shape and larger dimension relative to the canard used with a smaller projectile. For instance, the canard shown in FIG. 8B includes the base canard section 60 and the first and second canard tabs 62, 64. Canard 18 in this configuration is useable with a larger projectile, such as a 155 mm projectile.

When it is desired that the fuze kit 16 having the one or more canards 18 with the adjustable shape and dimensions be used with a smaller projectile such as a 127 mm or 105 mm projectile one or more of the first and second canard tabs 62, 64 are removed from the canard base section 60. In one example, the first and second canard tabs are removed along scored portions 30 of the canard 18. In the field, for instance, a technician would use bare hands or a tool to grasp one of the first and second canard tabs 62, 64 to fracture the tab from the base canard section 60 thereby adjusting the shape of the canard 18 according to correspond with the specified projectile.

In operation, where the adjustable canard 18 having the first and second canard tabs 62, 64 is used with a larger projectile such as a 155 mm projectile. The canard 18 is left in its initial configuration with the first and second canard tabs 62, 64 connected with the base canard section 60. In a second configuration where the fuze kit 16 is coupled with a second projectile, such as a 127 mm projectile, the first canard tab 62 is removed from the canard 18 leaving the base canard section 60 and second canard tab 64 coupled together to form the canard 18. The smaller shape and dimensions of the canard 18 in the second configuration provide the necessary guidance surfaces needed to guide the smaller projectile along a desired trajectory. In a third configuration, where the fuze kit 16 is used with a smaller projectile, such as a 105 projectile, the first and second canard tab 62, 64 are removed from the base canard section 60 leaving only the base canard section 60 as part of the canard 18. The smaller shape and dimensions of the canard 18 with the base canard section 60 provides sufficient guidance to the projectile to maintain the projectile along a desired trajectory when launched. In each of the configurations, where one or more of the canard tabs 62, 64 are removed from the canard 18 the canard is dimensioned and shaped to provide guidance without providing excessive guide surfaces that would otherwise cause tipping and tumbling of the projectile after the launch.

Figure 9A:
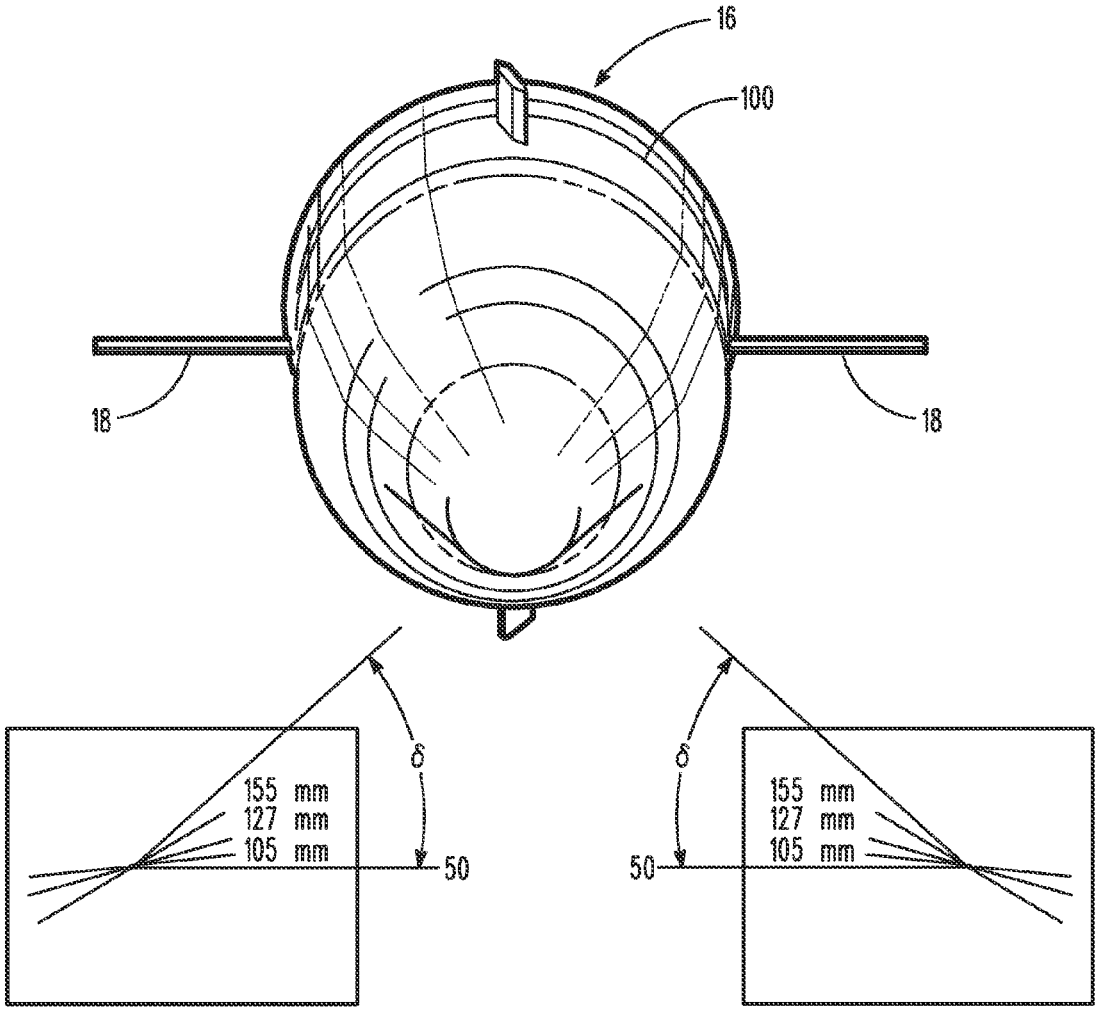
FIG. 9A is a front perspective view of another example of a projectile including one or more rotatable adjustable canards with a push-lock locking mechanism in accordance with some embodiments.
Figure 9B:
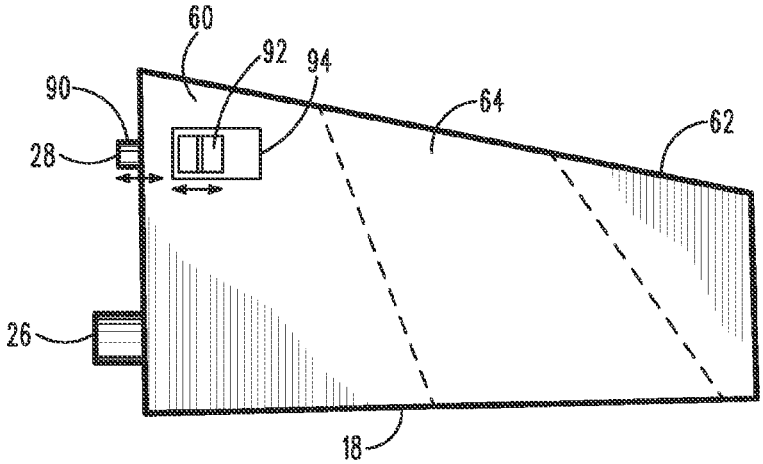
FIG. 9B is a top view of the one or more rotatable adjustable canards shown in FIG. 9A with an adjustable shape and the push-lock tool interface in accordance with some embodiments.

Another example of a configurable fuze kit 16 is shown in FIGS. 9A and 9B. As previously described, the fuze kit 16 includes one or more canards 18 that are adjustable and able to guide a variety of projectiles having different dimensions and mass moments of inertia along desired trajectories. As previously described in one example, the one or more canards 18 shown in FIGS. 9A and 9B are rotatable around a canard pin 26. The canards 18 include a locking mechanism 28 sized and shaped to position the locking mechanism within one or more grooves 21, 23, 25 corresponding to positions 20, 22, 24 relative to a bore site 50 of the fuze kit 16. Positioning of the one or more canards 18 in the grooves 21, 23, 25 configures the canards to provide a desired guiding surface for the fuze kit 16 corresponding to a specified projectile size. For instance and as described above, position 20 with the groove 21 positions the rotatable canard 18 at an angle ∂ sufficient to provide guidance to the large projectile such as a 155 mm projectile. In contrast, positioning the rotatable canard 18 at a position 24 corresponding to the groove 25 puts the rotatable canard 18 at an angle ∂ relative to the bore site 50 smaller than that for the 155 mm projectile but sufficient to guide a smaller projectile such as a 105 projectile along a specified trajectory. Positioning of the one or more canards 18 at the smaller angle ∂ also substantially prevents the one or more canards 18 from providing an excessive amount of guidance to the projectile that would otherwise cause tipping and tumbling of the projectile after launch.

Referring now to FIG. 9B, another example of a locking mechanism 28 including a push lock feature 92 is shown. Locking mechanism 28 includes a projection 90 positionable within one or more of the grooves 21, 23, 25 shown in FIG. 3. In one example, the projection 90 is biased into a projecting position relative to the canard 18 by a biasing element such as a spring. The push lock locking mechanism 28 shown in FIG. 9B includes a lock release 92 slidable within a lock slot 94. In one example, the lock slot 94 and locking slide 92 are recessed relative to an exterior surface of the canard 18 thereby positioning the locking mechanism 28 including the locking slide 92 and lock groove 94 outside of the aerodynamic surfaces of the canard 18 to substantially prevent interference with the guidance function of the canard 18. In operation, a technician places a tool within the locking slide 92 and operates the locking slide 92 to slide it away from the end of the canard 18 having the projection 90. The locking slide 92 is mechanically coupled with projection 90 and movement of the locking slide 92 correspondingly moves the projection 90 into the canard 18 allowing rotation of the canard 18 relative to the fuze kit 16. Once the rotatable canard 18 is positioned within a desired groove, such as the grooves 21, 23, and 25 shown in FIG. 3, the technician removes the tool from the locking slide 92 allowing the bias of the locking mechanism 28 to move the projection 90 into the desired groove thereby locking the rotatable canard 18 in the desired position relative to the fuze kit 16. The push lock system for the locking mechanism 28 thereby provides another mechanism to allow adjustment of the position of the canards 18 and locking of the canards after positioning.

As further shown in FIG. 9B, the locking mechanism 28 including the projection 20, locking slide 92, and lock groove 94 of a push lock system are contained within the base canard section 60 as opposed to the first and second canard tab 62, 64. The locking mechanism 28 thereby remains within the canard 18 despite changes to the canard shape and dimensions. That is to say, the push lock locking mechanism 28 remains within the canard 18 coupled with the fuze kit 16 whether the canard is in a first configuration where the first and second canard tabs 62, 64 are coupled with the base canard 60, a second configuration where the first canard tab 62 is removed from the canard 18, and a third configuration where the first and second canard tabs 62, 64 are removed from the base canard section 60. As previously described, the one or more canards 18 shown in FIGS. 9A and 9B include one or both of the rotatable and shape adjusting features of the canards described herein. That is to say, the one or more canards 18 may be only rotatable in nature. In another example, the one or more canards 18 are adjustable with regard to shape and dimensions, for instance, by removal of the first and second canard tab 62, 64 from the base canard section 60. In still another example, the one or more canards 18 include a combination of the rotatable features of the canard 18 through an angle delta and adjustment of the canard shape and dimensions through removal of the first and second canard tab 62, 64 according to the specified projectile size the fuze kit 16 is used with.

Methods for modifying a fuze kit for a particular projectile size are described herein. A fuze kit having an adjustable canard is provided for a projectile, regardless of the caliber. Depending upon the caliber of the projectile, the adjustable canard is set to a predetermined position on the fuze kit. The predetermined position will be defined by an angle, ∂. Additionally, the size of the canard 18 will be set on the fuze kit. The fuze kit is manufactured to the most aggressive need. In other words, the fuze kit 16 is configured in an initial configuration with the canards having their largest shape and greatest angle, ∂ for use with the largest projectile specified for coupling with the fuze kit. Configuring of the fuze kit 16 for use with a smaller projectile involves one or both of adjusting the angle, ∂ or shape of the canard 18. As described above, at least one scored portion of the canard 18 is "snapped off", in one example, as required by the caliber of the projectile coupled with the fuze kit 16. In another example, one or more canards 18 are rotated relative to the fuze kit 16 to position the canards at angles according to the caliber of the projectile.

Figure 10:
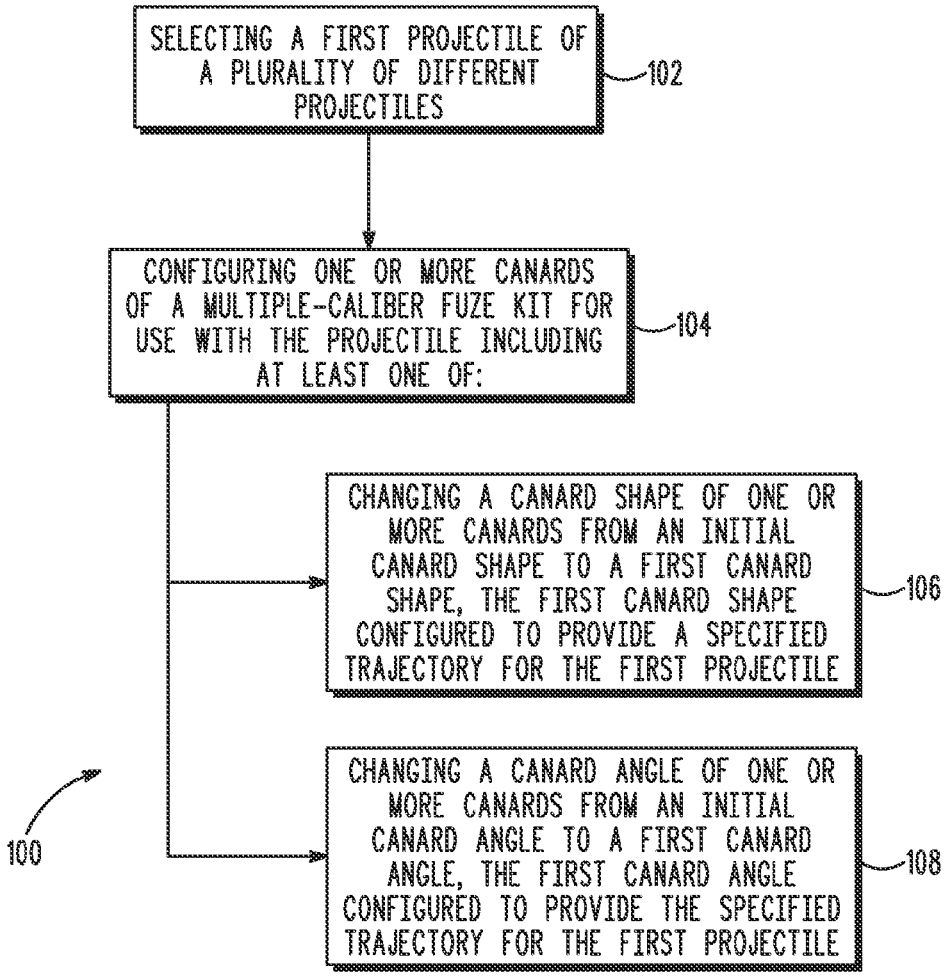
FIG. 10 is a block diagram showing one example of a method of using a multi-caliber fuze kit in accordance with some embodiments.

FIG. 10 shows one example of a method 100 for using a multi-caliber fuze kit, such as the fuze kit 16 shown in FIGS. 1 through 9B. Where applicable reference is made to features previously described above. At 102, a first projectile is selected from a plurality of different projectiles. For instance, a first projectile may include one of a 155 mm projectile, a 127 mm projectile, a 105 projectile or any other projectile of differing caliber sized and shaped to couple with the multi-caliber fuze kit 16. At 104, one or more canards 18 of the multi-caliber fuze kit 16 are configured for use with the specified projectile. Configuring the one or more canards 18 includes at least one of changing a canard shape or dimensions and changing a canard angle. Optionally, configuring one or more canards includes both changing the canard shape and changing the canard angle of one or more canards 18.

At 106, a canard shape of the one or more canards 18 is changed from an initial canard shape to a first canard shape. The first canard shape is configured to provide a specified trajectory for the first projectile as described above and shown in FIGS. 5, 8B and 9B. In one example, an initial configuration of a canard 18 includes a base canard section 60 and first and second canard tabs 62, 64 coupled with the base canard section 60. This initial configuration provides the largest shape and largest dimensions for the canard 18 and corresponds to the largest projectile the multi-caliber fuze kit 16 is configured to couple with. Where the first canard shape corresponds to the canard shape used with the largest projectile, for instance, a 155 mm projectile, the first canard shape is identical to the initial canard shape shown in FIG. 5. Where the first canard shape differs from the initial canard shape (e.g., the shape shown in FIG. 5) because the fuze kit will be coupled with a first projectile smaller than the projectile used with the larger configuration, one or more of the first and second canard tabs 62, 64 are removed from the canard 18. The removal of one or more of these tabs decreases at least one of the dimensions or size of the canard 18 to provide a guiding surface capable of guiding the specified projectile along the desired trajectory without causing tipping and tumbling of the projectile due to an excessively large or improperly shaped canard 18. As described previously, removal of the first and second canard tabs 62, 64 includes in one example snapping of the canard tabs at scored portions 30 formed on the canard 18.

At 108, configuring one or more of the canards 18 of the multi-caliber fuze kit 16 includes changing a canard angle, such as an angle delta, of one or more canards 18 from an initial canard angle to a first canard angle. The first canard angle is configured to provide the specified trajectory for the first projectile. Referring to FIGS. 8A and 8B, the one or more canards 18 are rotatably coupled with the multi-caliber fuze kit 16 at canard pins 26. Where the initial canard angle differs from the first canard angle the canard 18 is rotated relative to the fuze kit to position the canard in the necessary orientation relative to a bore site 50 of the multi-caliber fuze kit 16 to provide an angled guide surface that will appropriately guide the specified projectile on the desired trajectory without causing tipping and tumbling of the projectile.

Referring to FIG. 3, in one example, the rotatable canard 18 is moved between one or more grooves 21, 23, and 25 corresponding to positions 20, 22, and 24 for a variety of projectiles having differing dimensions and mass moments of inertia. As shown in FIGS. 8A, 8B the larger angles ∂ are assigned to larger projectiles, such as a 155 mm projectile. The greater angle ∂ provides enhanced guiding of the projectile coupled with the multi-caliber fuze kit 16 to achieve a desired trajectory for the projectile after launch. Rotation of the canard 18 to the grooves 23, 25, corresponding in one example, to a 127 mm projectile and 155 mm projectile, respectively, positions the canard 18 at appropriate angles ∂ to provide sufficient guidance for the projectile without causing tipping and tumbling of the projectile after launch. As described above and shown in FIG. 4 and FIG. 8B, changing the canard angle includes in one example, disengaging a locking mechanism 28 such as a detent from one of the initial detent grooves 21, 23, 25 corresponding to an initial canard angle. Canard 18 is then rotated from the initial canard angle to the first canard angle and the detent in the locking mechanism 28 is engaged in a first detent groove corresponding to the first canard angle. In yet another example, changing the canard angle includes disengaging the detent of the locking mechanism 28 from one of the initial and first detent grooves (e.g., grooves 21, 23), rotating the canard 18 from one of the initial and first canard angles to a second canard angle and then engaging the locking mechanism 28 (detent) in a second detent groove, such as detent groove 25 corresponding to the second canard angle. In still another example, the method 100 includes changing a canard angle of one or more canards 18 from an initial canard angle to a first canard angle with a locking mechanism 28, such as the push lock system shown in FIG. 9B. A locking slide 92 is actuated relative to the canard 18 to move a projection 90 out of engagement with a groove such as grooves 21, 23, 25. The canard 18 is then rotated relative to the fuze kit 16 and the locking slide 92 is released relative to the canard 18 to allow the projection 90 to engage with the fuze kit 16 through reception within the desired groove for the desired angle ∂.

Several options for the method 100 are described below. In one example, the method 100 includes coupling the multi-caliber fuze kit 16 with the first projectile, for example, before or after configuration of the one or more canards 18. In another option, the method 100 further includes decoupling the multi-caliber fuze kit 16 from an initial projectile where the multi-caliber fuze kit includes the canards 18 configured with at least one of the initial canard shape or the initial canard angle. For instance, the multi-caliber fuze kit 16 is coupled with an initial projectile in the field or during factory assembly and because of needs in the field at least one of the one or more canards of the multi-caliber fuze kit 16 are configured into one or more of a first canard shape and a first canard angle according to the dimensions and mass moment of inertia of the first projectile where the first projectile has different dimensions and mass moment of inertia relative to the initial projectile.

Figure 11:
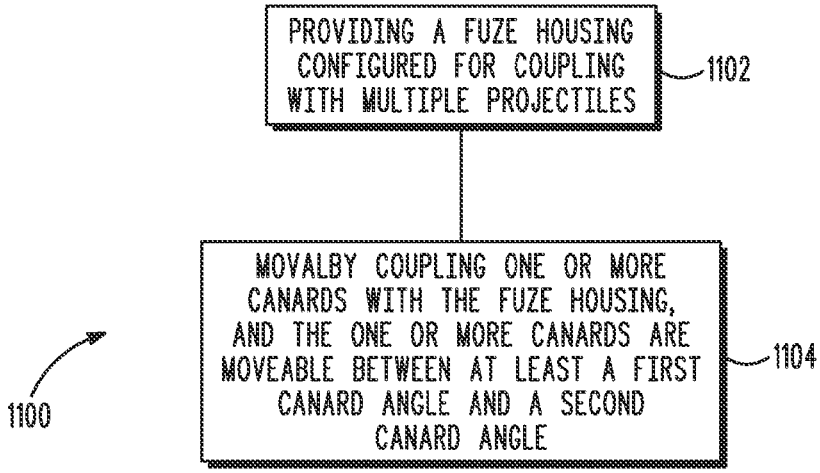
FIG. 11 is a block diagram showing one example of a method for making a multi-caliber fuze kit in accordance with some embodiments.

Referring now to FIG. 11, one example of a method 1100 for making a multi-caliber fuze kit is shown. At 1102, a fuze housing, such as fuze housing 100 shown in FIG. 2, is provided. The fuze housing 100 is sized and shaped for coupling with multiple projectiles, for instance, projectiles having differing dimensions and mass moments of inertia (e.g., 155 mm, 127 mm, 105 mm projectiles). In one example, the method 1100 includes forming a fuze coupling feature 102 sized and shaped for coupling with a corresponding projectile feature coupling 104 of the projectile 10 shown in FIGS. 1 and 2. This previously described fuze coupling feature 102 includes, but is not limited to, any of a number of mechanical coupling features such as threading, bolts, screws, mechanical interfitting features and the like.

At 1104, one or more canards 18 are movably coupled with the fuze housing 100. The one or more canards 18 are moveable between at least a first canard angle and a second canard angle as shown, for example, in FIGS. 3 and 6-9B. As shown in FIG. 4, in one example, the canard 18 includes a canard pin 26 sized and shaped to couple between the canard 18 and the fuze housing 100 to allow rotation of the canard 18 relative to the fuze housing. In another example, the method 1100 includes forming grooves such as grooves 21, 23, and 25 in the fuze housing 100. The grooves are sized and shaped to receive a locking mechanism 28. Rotation of the canard 18 relative to the fuze housing places the locking mechanism 28 over one or more of the grooves 21, 23, and 25 and allows the locking mechanism to engage with the fuze housing by projecting into the grooves 21, 23, and 25 thereby locking the canard 18 in place. In one option, the locking mechanism 28 includes a deflectable detent biased into a projecting orientation by a biasing element within the canard 18. Sufficient torque applied to the canard 18 causes the detent to overcome the bias of the biasing element and allows rotation of the canard relative to the fuze housing 100. After positioning of the canard 18 over a desired groove 21, 23, and 25 the detent deflects and enters into the desired groove to fix the canard 18 in place.

In yet another example shown in FIG. 9B, the method 1100 includes forming a locking mechanism 28, such as a push lock system having a projection 90, a locking slide 92 and slide groove 94, into the one or more canards 18. The locking mechanism 28 shown in FIG. 9B (the push lock system) is operated by engaging a tool with the locking slide 92 and moving the locking slide relative to the canard 18 to move the projection 90 into the canard 18. Moving the projection into the canard allows the canard to rotate relative to the fuze housing 100. Once the canard is rotated into a desired position where the projection 90 is above a corresponding groove 21, 23, and 25 the locking slide 92 is released and the projection 90 is free to project out of the canard 18 and into the desired groove.

In another example, the method 1100 includes coupling one or more canards 18 with the fuze housing 100, and one or more canards are adjustable between at least a first canard shape and a second canard shape. Referring to FIGS. 5, 8B and 9B, a canard 18 is shown having a base canard section 60 and first and second canard tabs 62, 64. Scored portions 30 are formed in the canard 18 between the first and second canard tabs 62 and 64 and the second canard tab 64 and the base canard section 60. In one example, the scored portions 30 included scoring cuts made into the canard 18. In another example, the scored portions 30 included perforations through the canard 18. As previously described above, to adjust the shape of the canard 18 pressure is applied to one or more of the first and second canard tabs 62 and 64 to remove one or both of the tabs from the base canard section 60. For instance, one or more of the first and second canard tabs 62, 64 are snapped off of the adjacent portion of the canard 18.

Optionally, the method 1100 includes coupling the one or more canards 18 with the fuze housing 100 where one or more of the canards include the adjustable shape as described and the rotatable feature allowing the canard to move between at least the first canard angle and second canard angle. Canards with both features are thereby able to rotate and are capable of having the canard shape and dimensions changed. In yet another option, the method 1100 includes coupling one or more canards 18 with the fuze housing 100 where the one or more canards are adjustable between the first and second canard shapes (in contrast to the canards being rotatable). That is to say, the one or more canards 18 are fixed relative to the fuze housing 100 and only adjustable in shape, for instance, by removing one or more of the first and second canard tabs 62 and 64.

CONCLUSION

The multi-caliber fuze kit shown in the attached figures and specification provides a fuze kit that allows for configuration in the field and coupling with a plurality of projectiles having differing dimensions and mass moments of inertia. The multi-caliber fuze kit is able to guide any of these different projectiles along a desired trajectory according to the adjustable configuration of the canards. In one example, the one or more canards coupled with the multi-caliber fuze kit are rotatable relative to the fuze kit providing guide surfaces at a variety of angles according to the dimensions and mass moment of inertia of the projectile to which the multi-caliber fuze kit is to be coupled. By adjusting the angles of the canard from an orientation originally intended for a larger projectile, such as a 155 mm projectile, to a smaller angle for a corresponding smaller projectile the canards of the fuze kit continue to provide appropriate guidance to either projectile while substantially preventing tipping or tumbling of smaller projectiles that would use otherwise fixed canards configured for a much larger projectile. In still another example, the multi-caliber fuze kit includes configurable canards adjustable between multiple shapes and dimensions according to the size and mass moment of inertia of the projectile to which the fuze kit is coupled. In one option, at least one of the first and second canard tabs are removed from a base canard section to adjust the shape of the canard according to the projectile dimensions and mass moment of inertia the fuze kit is coupled with. The canard with the adjustable shape and dimensions begins in an initial configuration with a large area and length useable with a larger projectile (e.g., a 155 mm projectile). A technician then adjusts the canard, for instance by removing one or more of the canard tabs to configure the canard for guiding of a smaller projectile, such as a 127 mm or 105 mm projectile. In a similar manner to the rotatable canards, by configuring the canards with smaller shapes according to the dimensions and mass moments of inertia of projectiles that are smaller than an initial projectile tumbling and tipping of the smaller projectiles are avoided. Optionally, the fuze kit includes one or more canards that are configurable by rotation as well as by changes in shape.

A further benefit of the multi-caliber fuze kit shown in the figures and in the specification is the field configurable nature of the multi-caliber fuze kit. A technician in the field is able to rotate the one or more canards relative to the fuze kit by operating a locking mechanism that retains the one or more canards in a rotationally fixed position relative to the fuze housing. Once the one or more canards are positioned in the desired orientation the locking mechanism engages with the fuze housing to retain the one or more canards in the desired orientation. Similarly, a technician in the field is able to grasp and remove one or both of the first and second canard tabs from the base canard section. For example, a technician may grab one or both of the first and second canard tabs and applied torque to the canard to snap the first or second canard tab off of the canard leaving either the remaining canard tabs and the base canard section or the base canard section by itself. Rapid modifications to the multi-caliber fuze kit are thereby easily performed in the field facilitating immediate reconfiguration of the multi-caliber fuze kit and immediate coupling with a differing projectile with different dimensions and mass moment of inertia.

In this regard, the inventive subject matter can be incorporated into a standard fuze kit that is built in a form that is scaled to the most aggressive need for a projectile (e.g., the largest projectile specified for coupling with the fuze kit). The canard is adjustable in position, shape and size. Modifications are made to the fuze kit depending on the projectile size the kit is used with. The fuze kit can be adapted, at the time it is applied to a particular projectile, to specific dimensions and the mass moment of inertia of the projectile to provide trajectory correction and control.

The particular implementations shown and described are illustrative of the subject matter and its best mode and are not intended to otherwise limit the scope of the present subject matter in any way. Indeed, for the sake of brevity, conventional manufacturing, connection, preparation, and other functional aspects of the system may not be described in detail. Furthermore, the connecting lines shown in the various figures are intended to represent exemplary functional relationships and/or physical couplings between the various elements. Many alternative or additional functional relationships or physical connections may be present in a practical system.

In the foregoing description, the subject matter has been described with reference to specific exemplary examples. However, it will be appreciated that various modifications and changes may be made without departing from the scope of the present subject matter as set forth herein. The description and figures are to be regarded in an illustrative manner, rather than a restrictive one and all such modifications are intended to be included within the scope of the present subject matter. Accordingly, the scope of the subject matter should be determined by the generic examples described herein and their legal equivalents rather than by merely the specific examples described above. For example, the steps recited in any method or process example may be executed in any order and are not limited to the explicit order presented in the specific examples. Additionally, the components and/or elements recited in any apparatus example may be assembled or otherwise operationally configured in a variety of permutations to produce substantially the same result as the present subject matter and are accordingly not limited to the specific configuration recited in the specific examples.

Benefits, other advantages and solutions to problems have been described above with regard to particular examples; however, any benefit, advantage, solution to problems or any element that may cause any particular benefit, advantage or solution to occur or to become more pronounced are not to be construed as critical, required or essential features or components.

As used herein, the terms “comprises”, “comprising”, or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present subject matter, in addition to those not specifically recited, may be varied or otherwise particularly adapted to specific environments, manufacturing specifications, design parameters or other operating requirements without departing from the general principles of the same.

The present subject matter has been described above with reference to examples. However, changes and modifications may be made to the examples without departing from the scope of the present subject matter. These and other changes or modifications are intended to be included within the scope of the present subject matter, as expressed in the following claims.

It is to be understood that the above description is intended to be illustrative, and not restrictive. Many other examples will be apparent to those of skill in the art upon reading and understanding the above description. It should be noted that examples discussed in different portions of the description or referred to in different drawings can be combined to form additional examples of the present application. The scope of the subject matter should, therefore, be determined with reference to the appended claims, along with the full scope of equivalents to which such claims are entitled.

What is claimed is:

1. A multi-caliber fuze kit for use with projectiles comprising:

a fuze housing configured for coupling with multiple projectiles; and one or more canards moveably coupled with the fuze housing, the one or more canards moveable to two or more canard configurations, wherein:

a first canard configuration is at a first canard angle relative to a bore sight of the fuze housing, and the first canard includes a first canard shape in the first canard configuration, the first canard angle and the first canard shape are configured for use with a first projectile, and a second canard configuration is at a second canard angle relative to the bore sight of the fuze housing, and the second canard includes a second canard shape in the second canard configuration, the second canard angle and the second canard shape are configured for use with a second projectile, and the respective first and second canard angles and the first and second canard shapes are different.

2. The multi-caliber fuze kit of claim 1, wherein the first canard angle is configured to provide a first specified trajectory to a first projectile having first projectile dimensions and a first mass moment of inertia, and the second canard angle is configured to provide a second specified trajectory to a second projectile having second projectile dimensions and a second mass moment of inertia different from the first projectile dimensions and the first mass moment of inertia.

3. The multi-caliber fuze kit of claim 1, wherein the first projectile is a 155 mm projectile, and the second projectile is a 105 mm projectile.

4. The multi-caliber fuze kit of claim 1, wherein the one or more canards are movable to at least a third canard configuration between the first and second canard positions, wherein the third canard configuration is at a third angle relative to the bore sight.

5. The multi-caliber fuze kit for use with projectiles of claim 1, wherein the one or more canards include a detent, and the fuze housing includes first and second detent grooves sized and shaped to receive the detent:

the first canard configuration includes the detent positioned in the first detent groove, and the second canard configuration includes the detent positioned in the second detent groove.

6. The multi-caliber fuze kit for use with projectiles of claim 1, wherein the one or more canards are rotatably coupled to the fuze housing with a canard pin.

7. A multi-caliber fuze kit for use with projectiles comprising:

a fuze housing configured for coupling with multiple projectiles;

one or more canards coupled with the fuze housing, the one or more canards are adjustable between two or more canard configurations, wherein:

a first canard configuration includes a first canard angle and a first canard shape configured to provide a first specified trajectory with a first projectile, a second canard configuration includes a second canard angle and a second canard shape configured to provide a second specified trajectory with a second projectile, and at least one of the first canard angle and the first canard shape are different from the second canard angle and the second canard shape.

8. The multi-caliber fuze kit of claim 7, wherein the first projectile includes first projectile dimensions and a first mass moment of inertia, and the second projectile includes second projectile dimensions and a second mass moment of inertia different from the first projectile dimensions and the first mass moment of inertia.

9. The multi-caliber fuze kit of claim 7, wherein the canard includes a base canard section coupled with the fuze housing and one or more canard tabs removably coupled with the base canard section, and the first canard shape includes the base canard section coupled with a first canard tab, and the second canard shape includes the base canard section without the first canard tab.

10. The multi-caliber fuze kit of claim 9, wherein a third canard shape of a third canard configuration includes the base canard section coupled with the first canard tab and a second canard tab coupled with at least one of the first canard tab and the base canard section.

11. The multi-caliber fuze kit of claim 9, wherein the first canard tab is coupled with the canard base section with a scored portion of the canard therebetween.

12. The multi-caliber fuze kit of claim 7, wherein the one or more canards are adjustable to a third canard configuration including a third canard angle and a third canard shape configured to provide a third specified trajectory with a third projectile, and at least one of the third canard angle and the third canard shape are different from the first and second canard angles and the first and second canard shapes.

13. A multi-caliber fuze and projectile kit comprising:

a first projectile with first projectile dimensions and a first mass moment of inertia;

a second projectile with second projectile dimensions and a second mass moment of inertia, and the second projectile dimensions and the second mass moment of inertia are different from the first projectile dimensions and the first mass moment of inertia; and a multi-caliber fuze kit including:

a fuze housing configured for coupling with at least the first and second projectiles;

one or more canards coupled with the fuze housing, the one or more canards are adjustable between two or more canard configurations, wherein:

a first canard configuration includes a first canard angle configured to provide a first specified trajectory with the first projectile, and the first canard configuration includes a first canard shape, a second canard configuration includes a second canard angle configured to provide a second specified trajectory with the second projectile, the first canard angle is different from the second canard angle, and the second canard configuration includes a second canard shape, the first and second canard shapes are different.

14. The multi-caliber fuze and projectile kit of claim 13, wherein the one or more canards each include a base canard section coupled with the fuze housing and one or more canard tabs removably coupled with the base canard section, and the first canard shape includes the base canard section coupled with a first canard tab, and the second canard shape includes the base canard section without the first canard tab.

15. The multi-caliber fuze and projectile kit of claim 14, wherein the first canard tab is coupled with the canard base section with a scored portion of the canard therebetween.

16. The multi-caliber fuze and projectile kit of claim 13, wherein the one or more canards each include a detent, and the fuze housing includes first and second detent grooves sized and shaped to receive the detent:

the first canard configuration includes the detent positioned in the first detent groove, and the second canard configuration includes the detent positioned in the second detent groove.

17. The multi-caliber fuze and projectile kit of claim 13, wherein the one or more canards are rotatably coupled to the fuze housing with canard pins.

18. The multi-caliber fuze and projectile kit of claim 13, wherein the first and second canard angles are measured relative to a bore sight of the fuze housing.

* * * * *

UNITED STATES PATENT AND TRADEMARK OFFICE

CERTIFICATE OF CORRECTION

PATENT NO. : 8,513,581 B2
APPLICATION NO. : 12/469443
DATED : August 20, 2013
INVENTOR(S) : Geswender et al.

It is certified that error appears in the above-identified patent and that said Letters Patent is hereby corrected as shown below:

On the title page, item 56

In column 2, under "Other Publications", line 1, before "International", insert --"--, therefor In column 2, under "Other Publications", line 2, delete "2010," and insert --2010",--, therefor On page 2, in column 2, under "Other Publications", line 1, before "International", insert --"--, therefor On page 2, in column 2, under "Other Publications", line 2, delete "2010," and insert --2010",--, therefor In the drawings, On sheet 3 of 6, reference numeral 8, Fig. 7, delete "8" and insert --δ--, therefor On sheet 6 of 6, reference numeral 1104, Fig. 11, delete "MOVALBY" and insert --MOVABLY--, therefor In the specification, In column 9, line 32, delete "20," and insert --90,--, therefor In column 11, line 11, delete "155" and insert --105--, therefor In the claims, In column 16, line 3-4, in Claim 7, after "projectile;", insert --and--, therefor Signed and Sealed this
Twelfth Day of July, 2016

Michelle K. Lee

Michelle K. Lee
*Director of the United States Patent and Trademark Office*